United States Patent [19]

Mantovani

[11] 3,947,982

[45] Apr. 6, 1976

[54] STRUCTURE FOR CONNECTING TEETH TO THE DIGGING EDGE OF A BUCKET

[76] Inventor: Tomaso Mantovani, Via Giovecca, 35, Mirabello (Ferrara), Italy

[22] Filed: Dec. 9, 1974

[21] Appl. No.: 530,965

[30] Foreign Application Priority Data

Dec. 10, 1973 Italy ..... 29004/73
Jan. 2, 1974 Italy ..... 28901-A/74

[52] U.S. Cl. ..... 37/141 R; 299/91
[51] Int. Cl.[2] ..... E02F 9/28
[58] Field of Search ..... 37/142 R, 142 A, 141 R, 37/141 T; 299/91–93; 172/713

[56] References Cited

UNITED STATES PATENTS

| | | | |
|---|---|---|---|
| 1,485,243 | 2/1924 | Blake | 37/142 R |
| 1,775,984 | 9/1930 | Younie | 37/141 T |
| 3,426,459 | 2/1969 | Petersen | 37/142 R |

*Primary Examiner*—Clifford D. Crowder
*Attorney, Agent, or Firm*—Steinberg & Blake

[57] ABSTRACT

Digging edge structures for buckets of earthmoving machines, excavators, loaders, and the like. A bucket wall which has a front cutting edge region is formed with a notch which receives a receptacle of a hard, wear-resistant material. This receptacle is made up in its entirety of only a single pair of shells which are welded to each other and define the hollow interior of the receptacle, this hollow interior having a front open end through which a tang of a bucket tooth is adapted to be inserted into the hollow interior of the receptacle to be removably fastened therein in any suitable way. These shells which form the receptacle are welded to the bucket wall and at least one of the shells has a pair of laterally extending front lips which extend along the cutting edge region of the bucket wall while being welded thereto. These lips at their free ends are adapted to be welded to lips of adjoining receptacles for receiving adjoining bucket teeth, so that in this way the entire front cutting edge region of the bucket wall is covered and reinforced by the receptacle lips.

24 Claims, 27 Drawing Figures

STRUCTURE FOR CONNECTING TEETH TO THE DIGGING EDGE OF A BUCKET

BACKGROUND OF THE INVENTION

The present invention relates to buckets of the type which are used in earth-moving machines such as excavators, although such buckets also are used in all types of heavy machinery designed to move loose material, even for loading purposes.

Thus, buckets of the type to which the present invention relates are capable of being used on excavators, on front loaders, and in general on earth moving machines which are designed to handle loose material.

The invention relates in particular to the cutting edge region of such a bucket where it is provided with teeth.

At the present time, in order to accommodate such teeth, receptacles therefor are constructed of a pair of half-shells which may be welded together, with the cutting edge of the bucket being shaped suitable so as to support such shells which in turn carry the teeth. These shells are generally made of a hardened and tempered steel of approximately 90 kg/mm$^2$, while the cutting edge of the bucket wall is made of a relatively soft steel.

Conventional structures of the above type have certain disadvantages and inconveniences in that the cutting edge which is made of soft steel is exposed to extremely severe wear. At one time it had been attempted to provide such cutting edge regions of the buckets with a hardened and tempered steel, but even then the bucket wall was not sufficiently resistant to wear and at the same time the construction of such buckets was extremely expensive and they were difficult to purchase on the market in the required dimensions.

As a result this latter type of construction was abandoned and instead a construction was provided according to which angled members of hardened and tempered steel having a relatively great resistance to wear were welded to the cutting edge region of soft steel of the bucket wall itself. Thus, the intention was to protect the cutting edge region of the bucket wall in the space between the teeth with a construction of this type. However, satisfactory results were not achieved because of the small mechanical strength at the coupling between the reinforcing elements and the cutting edge region of the bucket wall. In addition, unsatisfactory results were obtained because the shells which were hardened and tempered for only 90 kg/mm$^2$.

Thus, up to the present time there has been no satisfactory solution to the problem of providing the front cutting edge region of a bucket of the above type with the properties required to resist wear while at the same time being capable of being economically constructed in a material such as soft steel which can be readily found on the market in the required dimensions. In other words, up to the present time it has not been possible to strengthen the soft steel of the cutting edge region of a bucket in an adequate manner which will provide for the bucket a long operating lift while at the same time providing constructions which can readily be used for buckets of all dimensions.

SUMMARY OF THE INVENTION

It is accordingly a primary object of the present invention to provide a construction which will avoid the above drawbacks.

In particular, it is an object of the present invention to provide for a bucket of the above general type a structure at the front cutting edge region of the bucket which will give to the bucket the required strength and resistance to wear while at the same time providing the possibility of manufacturing the bucket at a relatively low cost.

Furthermore, it is an object of the present invention to provide a construction of the above type which is readily adapted at low cost to any desired dimensions while at the same time enabling the cutting edge region of the bucket to be provided with any desired number of teeth at any desired distribution along the cutting edge region of the bucket.

In particular, it is an object of the present invention to provide a construction according to which it becomes possible to manufacture one type of receptacle for the cutting teeth with this one type of receptacle being readily adapted to the different dimensions and different desired tooth distributions for various types of buckets.

According to the invention the bucket wall has a front, substantially straight, cutting edge region where the bucket wall is formed with an elongated notch extending therethrough inwardly from this front cutting edge region while being substantially perpendicular thereto. A receptacle for receiving the tang of a bucket tooth is made in its entirety of a relatively hard, wear-resistant material and is situated in this notch. The receptacle has an outer peripheral region welded to the bucket wall while extending along this notch. This receptacle has an elongated hollow interior terminating in a front open end situated approximately at the front cutting edge region of the bucket wall receiving a bucket-tooth tang introduced into the hollow interior of the receptacle through its front open end. The receptacle is adapted to accommodate at its inner end region a means for fixing a bucket tooth to the receptacle by cooperation with the tang of the bucket tooth.

This receptacle is composed in its entirety of a pair of shells which together define the hollow interior of the receptacle. These shells engage each other at surfaces of the shells which are situated in the notch and which are welded to each other in order to form the receptacle from the shells.

At least one of these shells has a pair of front lips projecting laterally respectively in opposed directions from the front open end of the receptacle. These lips extend along the front cutting edge region of the bucket wall and are welded thereto. The lips respectively terminate in free ends adapted to be welded to free ends of adjoining lips of adjoining receptacles adapted to be received in additional notches of the bucket wall. Moreover, each shell has at its front open end an elongated reinforcing protrusion extending in the general direction of the front cutting edge of the bucket wall.

BRIEF DESCRIPTION OF DRAWINGS

The invention is illustrated by way of example in the accompanying drawings which form part of this application and in which.

Figure 1:
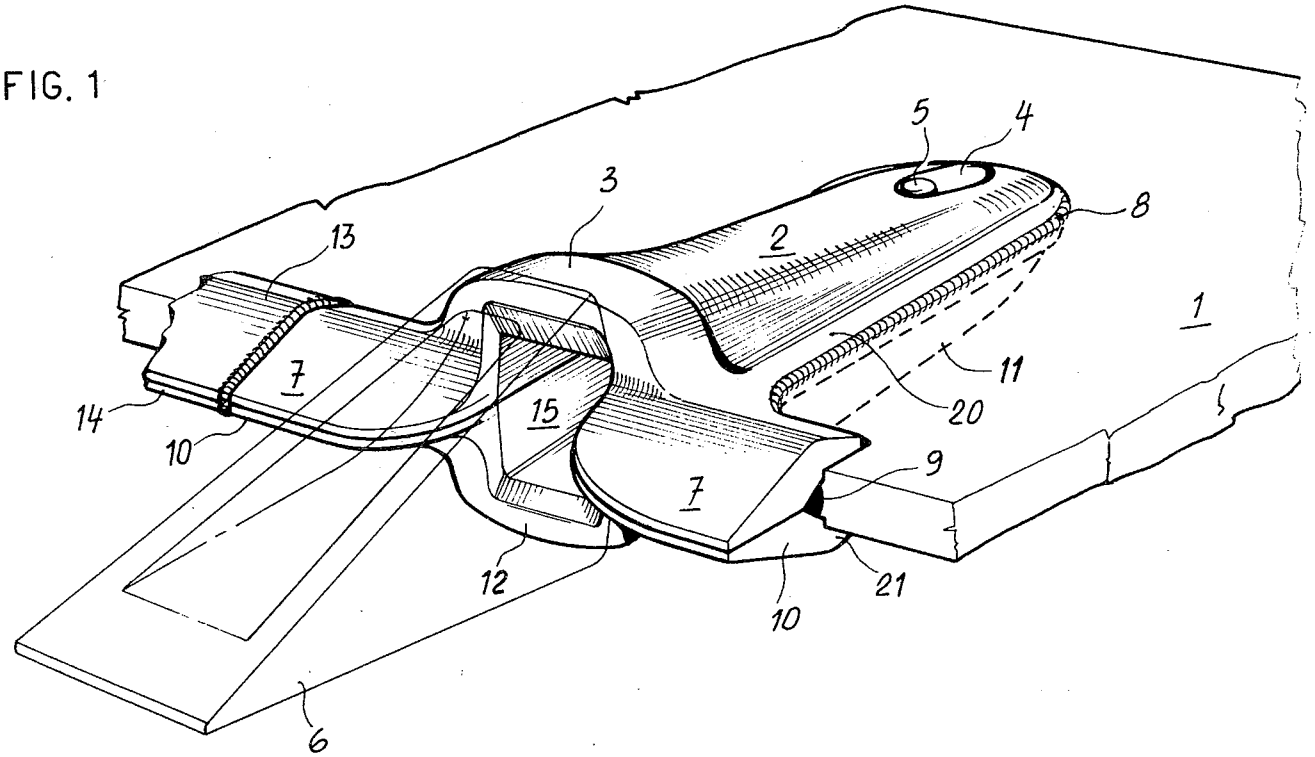
FIG. 1 fragmentarily illustrates part of a bucket wall at a front cutting edge region thereof, while also illustrating a bucket-tooth receptacle which is fixed to the front cutting edge region of the bucket wall, this receptacle being shown in perspective together with part of a bucket tooth which is shown in phantom lines, FIG. 1 also fragmentarily illustrating part of an adjoining receptacle for an adjoining bucket tooth.
Figure 3:
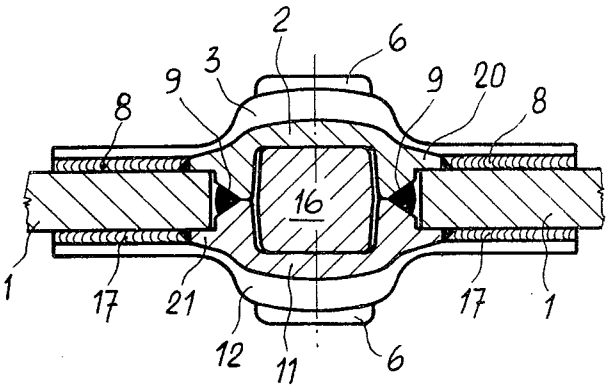
Figure 2:
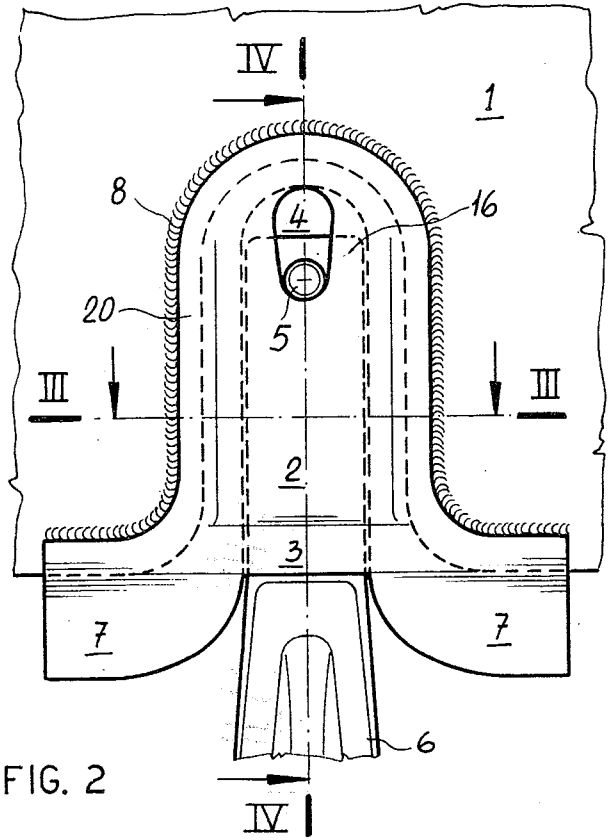
Figure 4:
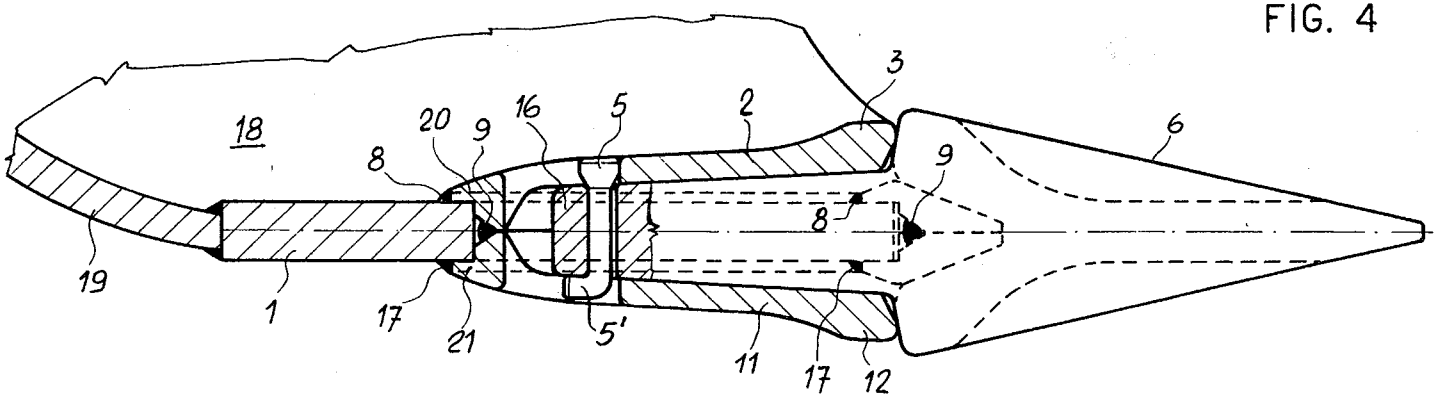
Figure 5:
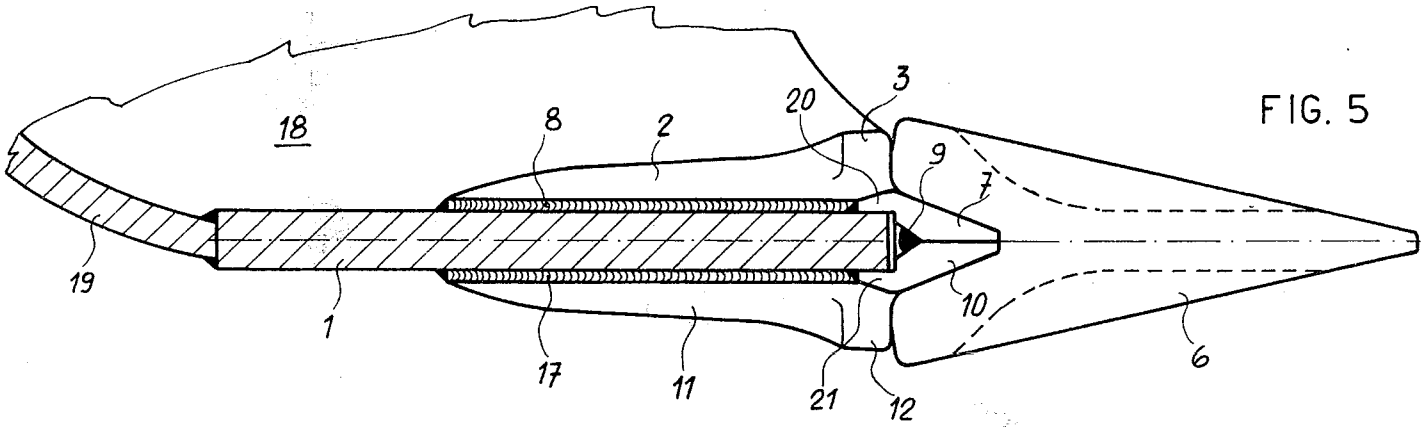
Figure 12:
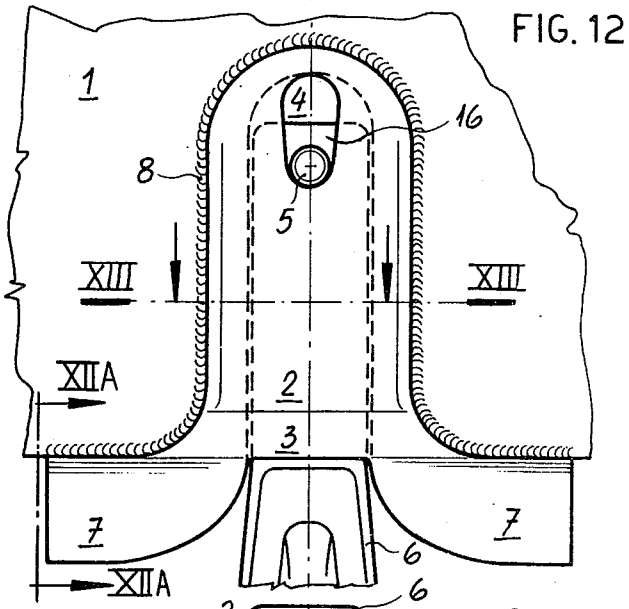
Figure 12A:
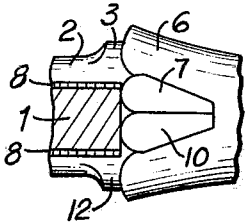
Figure 14:
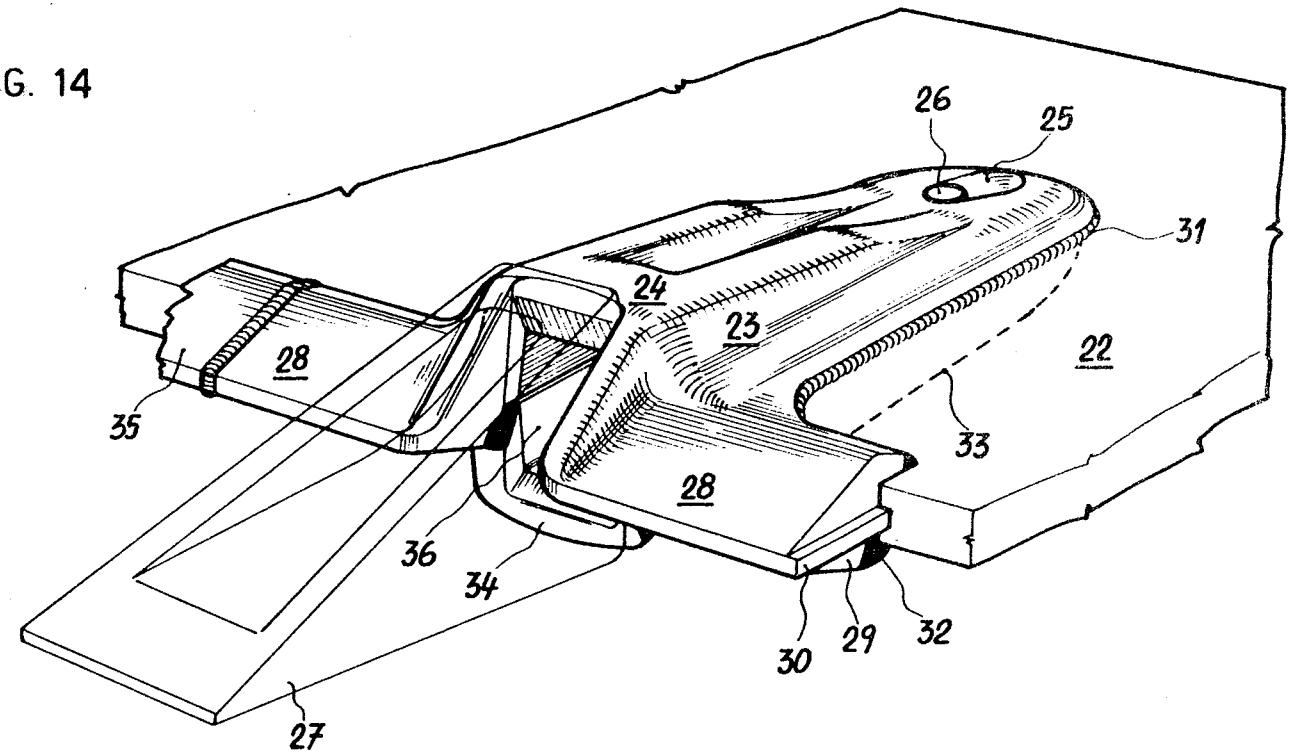
Figure 16:
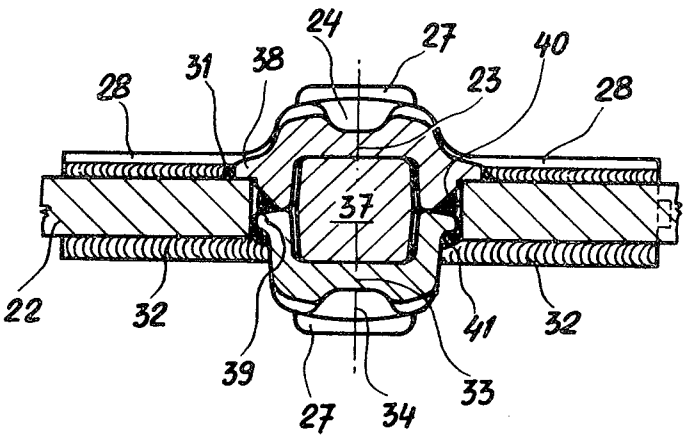
Figure 15:
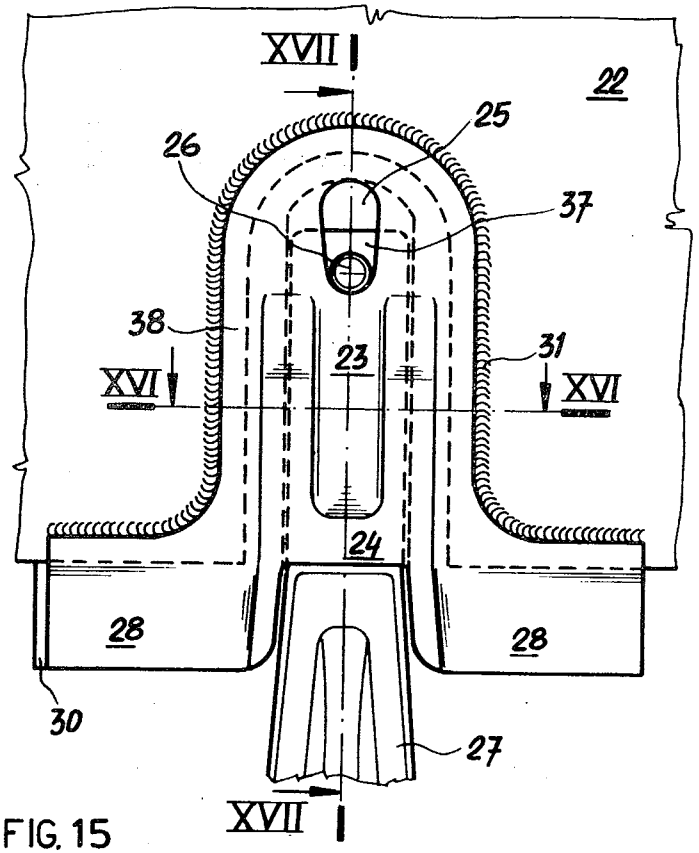
Figure 17:
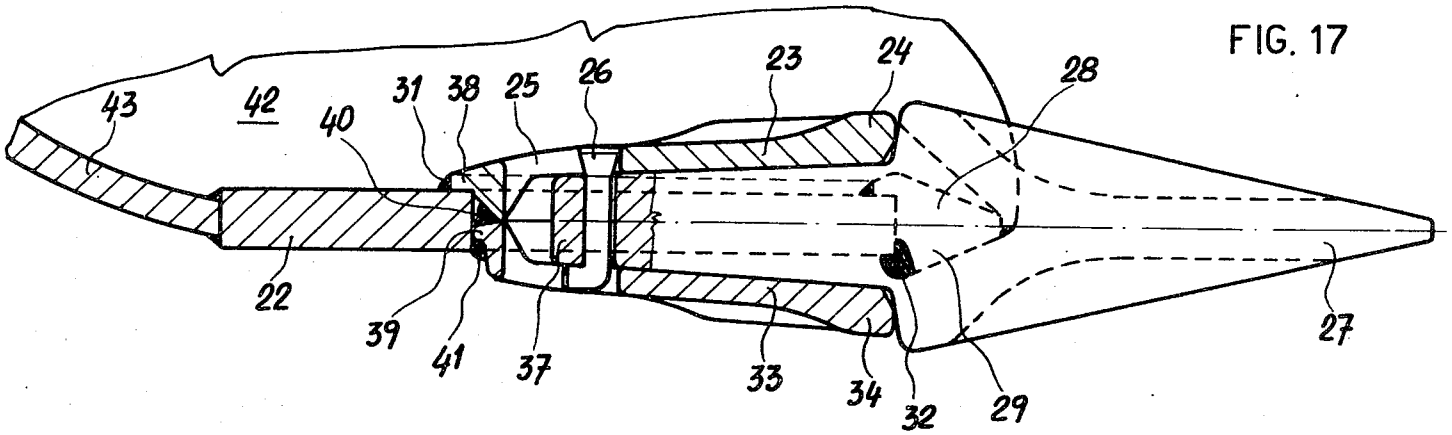
Figure 18:
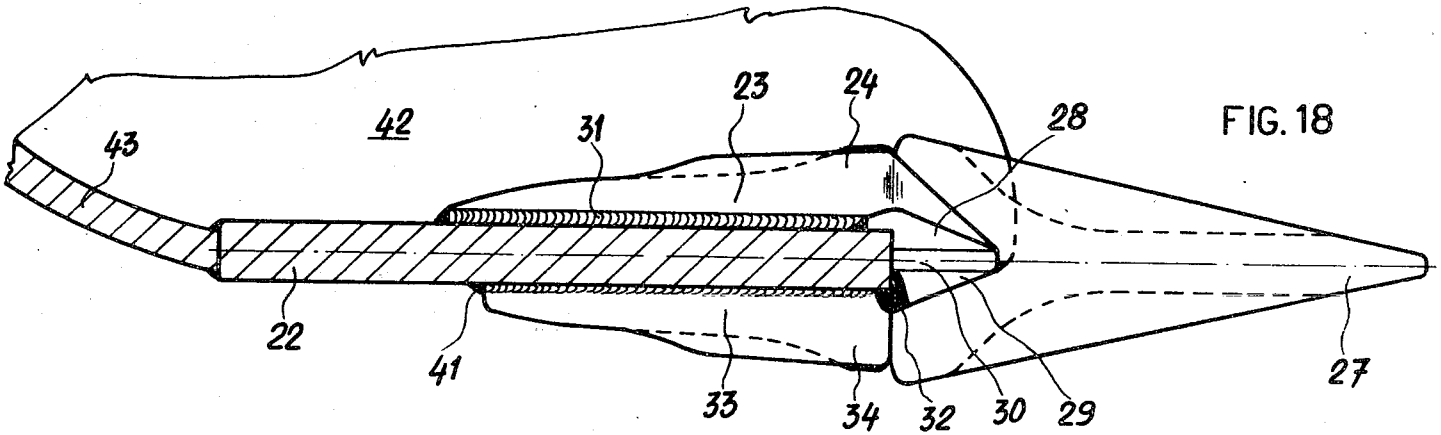

FIG. 2 is a plan view of the structure of FIG. 1;

FIGS. 3 and 4 are respectively sectional views taken along lines III—III and IV—IV of FIG. 2 in the direction of the arrows;

FIG. 5 is an end elevation of a receptacle and bucket-tooth assembly, the plane of FIG. 5 being taken at the ends of lips of the shells with the cutting edge region of the bucket wall and additional parts of the bucket being shown in FIG. 5, these same portions of the bucket being illustrated also in FIG. 4;

FIGS. 6, 8, 10, and 12 are respectively plan views of additional embodiments of the invention while FIGS. 7, 9, 11, and 13 are transverse sections respectively taken along lines VII—VII, IX—IX, XI—XI, and XIII—XIII of FIGS. 6, 8, 10 and 12 in the direction of the arrows;

FIG. 12A is a fragmentary sectional side elevation of the structure of FIG. 12 taken along line XIIA — XIIA in FIG. 12 in the direction of the arrows;

FIG. 14 is a fragmentary perspective illustration of that part of a bucket wall which is at the front cutting edge region thereof with FIG. 14 showing in perspective a further embodiment of a bucket-tooth receptacle of the invention with part of a bucket tooth being shown in phantom lines and with FIG. 14 also fragmentarily illustrating part of the structure of an adjoining receptacle for an adjoining bucket tooth;

FIG. 15 is a plan view of the structure of FIG. 14;

FIGS. 16 and 17 are respectively sectional elevations of the structure of FIG. 15 taken along lines XVI—XVI and XVII—XVII of FIG. 15 in the direction of the arrows;

FIG. 18 is a sectional view of the structure of FIG. 15 taken in a plane which is parallel to the plane of FIG. 17 but displaced to the outer end of a lip of the illustrated receptacle, with FIGS. 17 and 18 both showing not only the cutting edge region of the bucket but also additional wall structure of the bucket;

FIGS. 19, 21, 23, and 25 are respectively plan views of further embodiments of the invention, while FIGS. 20, 22, 24, and 26 are respectively transverse sections of the structures of FIGS. 19, 21, 23, and 25, respectively taken in the direction of the arrows along lines XX—XX, XXII—XXII, XXIV—XXIV, and XXVI—XXVI.

DESCRIPTION OF PREFERRED EMBODIMENTS

Referring now to FIGS. 1–5, it will be seen, particularly from FIGS. 4 and 5 that the bucket which is fragmentarily illustrated includes an inner wall portion 19 as well as a side wall portion 18 which are curved as illustrated in FIGS. 4 and 5. These wall portions of the bucket are joined, as by welding, to a front wall portion 1 of the bucket, this front wall portion being made of a soft steel, as described above, and terminating at its right, as viewed in FIGS. 4 and 5 in a front cutting edge region of the bucket.

Thus, it will be seen that FIG. 1 shows in perspective the front cutting edge region of the soft steel front wall portion 1 of the bucket. The inner surface of the bucket is visible in FIG. 1, this inner surface being directed upwardly, while the outer surface is directed downwardly and is not visible in FIG. 1.

The single cutting tooth 6 which is shown in phantom lines in FIG. 1 forms one of a series of such cutting teeth which are distributed along the front cutting edge region of the bucket wall 1, and this tooth 6 has a tang received in a hollow receptacle which has an upper shell 2 which is visible in FIG. 1, this upper shell 2 of FIG. 1 being the shell of the receptacle which is situated at the region of the inner surface of the bucket wall 1. This upper shell 2 of the illustrated receptacle terminates at its front end in a reinforcing protrusion 3 which extends in the general direction of the front cutting edge of the bucket wall 1. At its rear, inner end region, the upper shell 2 is formed with an opening 4 passing therethrough. This opening 4 is adapted to receive a pin 5 which forms a means for releasably fixing the tooth 6 with the receptacle, the means 5 being in the form of a pin which extends through an opening at the inner end region of the tang 16 of the tooth 6, as is illustrated in FIG. 4. It will be noted from FIG. 4 that the receptacle includes also a lower shell 11 which together with the shell 2 forms the receptacle for receiving the tang 16 of the tooth 6, and this shell 11 also has at its inner end region an opening identical with the opening 4 of the shell 2 and receiving the bend end 51 of the pin 5, as is shown in FIG. 4, so that through this means 5 the tooth is releasably retained in the illustrated receptacle. As is also apparent from FIGS. 1, 4, and 5, the outer shell 11 of the receptacle has at its front end a reinforcing protrusion 12 identical with the reinforcing protrusion 3 and extending in the general direction of the front cutting edge of the bucket wall 1.

In the embodiment of the invention which is illustrated in FIGS. 1–5, the pair of shells 2 and 11 are identical and are joined to each other at a common place which is situated substantially midway between the inner and outer surfaces of the wall 1, as is apparent from FIG. 3 where the tang 16 is shown in cross section within the hollow interior of the receptacle which is formed by the shells 2 and 11. It will be noted that along their surfaces which engage each other and which are situated in a notch of the bucket wall 1, the shells are provided with exterior bevelled surfaces 9 whicih define an elongated V-groove for receiving welding material which serves to join the shells to each other to form a receptacle according to the invention before this receptacle is introduced into the notch which is formed in the wall 1. Thus the wall 1 is formed with a notch extending therethrough and extending inwardly substantially perpendicularly from the substantially straight front cutting edge region of the wall 1, and it is this notch which receives the receptacle 2, 11.

The inner shell 2 has at its front end region a pair of lips 7 which extend laterally in opposite directions from the reinforcing protrusion 3, and these lips 7 form together witih the remainder of the shell 2 an inner peripheral edge 20 extending along the entire length of the shell 2 and overlapping the inner surface of the wall 1 while being welded to the latter by the line of welding material 8. It will be noted that the bevelled surfaces 9 also extend along the entire length of each of the shells to form the V-groove for receiving the welding material which joins the shells to each other along the entire length thereof, and as was pointed out above, these shells are joined to each other to form the complete receptacle before the latter is introduced into the notch of the wall 1. The lower or outer shell 11 has a pair of lips 10 identical with the lips 7 and extending in the same way laterally from opposed end regions of the front reinforcing protrusion 12 of the lower shell 11, and these lips 10 as well as the remainder of the lower shell 11 have along their entire length a peripheral edge 21 identical with the edge 20 and welded to the exterior outer surface of the wall 1 by the line of welding material 17.

As is shown in FIG. 1, the left ends of the lips 7 and 10 are welded to a pair of lips 13 and 14 which are fragmentarily illustrated and which form part of the next receptacle which is identical with the receptacle shown in FIG. 1 and which is adapted to receive another tooth 6, the front wall portion 1 of the bucket being formed with a series of notches which respectively receive a series of shells of the invention which are welded one to the next in the manner shown in FIG. 1 so that in this way a desired distribution of teeth along the cutting edge of the bucket will be provided while at the same time the direct welding of the lips of one shell to the lips of adjoining shells completely covers and reinforces the front cutting edge of the bucket wall 1.

As is apparent from FIG. 1, the receptacle of the invention has a front open end 15 situated substantially in line with the front cutting edge of the bucket wall 1, and it is through this front open end 15 that the tang 16 is introduced into the hollow interior of the receptacle 2, 11 of the invention.

With the above-described structure of the invention, the separate shells 2 and 11 are first welded to each other by the welding material situated in the V-groove formed by the bevelled surfaces 9, and this welding of the shells to each other takes place at the common plane where the shells engage each other and along the entire length of the shells.

Prior to joining the shells to each other, however, the length of the lips 7 and 10 will be selected so that the desired distribution of cutting teeth will be provided while at the same time the front cutting edge of the wall 1 will be completely reinforced and protected. In other words for a givien bucket the wall 1 will be formed with a series of notches having a given distribution along its front cutting edge. The shells 2 and 11 are initially manufactured with relatively long lips 7 and 10, and these can be cut to desired lengths so that the series of receptacles of the invention will match the distribution of the notches in such a way that the end surfaces of the lips of one sheel can be directly welded to the end surfaces of the lips of adjoining shells as described above.

With the lengths of the lips 7 and 10 thus made according to the required distribution as set forth above, the shell 2, 11 is placed in the notch formed in the plate 1 and welded to the latter by way of the welding lines 8 and 17 as described above. The last stage of the manufacture is the welding of the ends of the lips of successive receptacles to each other as shown for the line of weld between the lips 7 and 13 in FIG. 1, a similar welding being provided between the lips 10 and 14.

It is to be noted that it is not essential that the lips 7 and 10 terminate in end faces which are in a common plane. For example, one of the lips may be longer than the other so that the end surfaces of the lips 7 and 10 will be offset, and these offset end surfaces could be made to match with offset end surfaces of adjoining shells, so that in this way the welding of lips 7 and 13 to each other, for example, will be staggered with respect to the line of weld connecting the lips 10 and 14 to each other. With such a construction it is possible to achieve a superior resistance to bending.

Of course, the shells of the invention are made of a hard, wear-resistant material which will greatly strengthen the soft steel of the bucket wall portion 1. The shells 2 and 11 are preferably drop-forged and are made of a hardened and tempered anti-wear steel of high resistance, for example at 150 kg/mm$^2$.

Thus, by way of the lips 7, 10, 13, 14, etc. which extend along the entire length of the front cutting edge region of the wall 1, the mechanical resistance and strength thereof are greatly improved as well as the extent to which the structure can be subjected to wear.

Where, with the structure of the invention, the receptacle is made of a pair of identical shells, which presents certain advantages with respect to reducing the cost of manufacture, a construction as described above and shown in FIGS. 1–5 is preferred, although certain variations are possible as shown in FIGS. 6–13.

Figure 6:
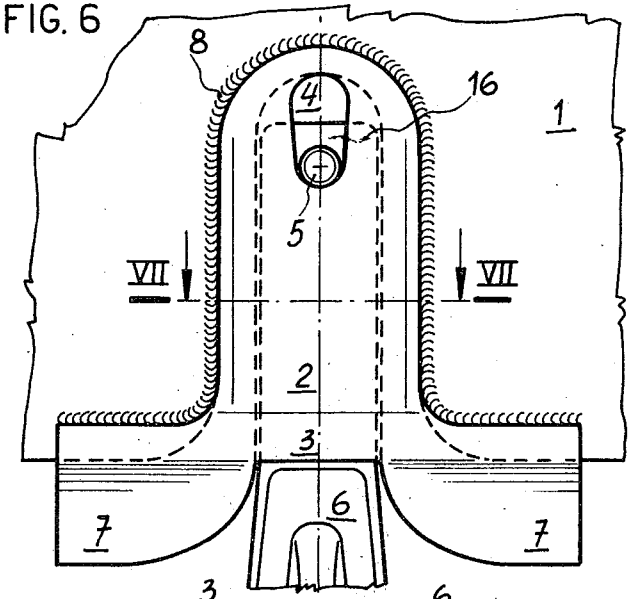
Figure 7:
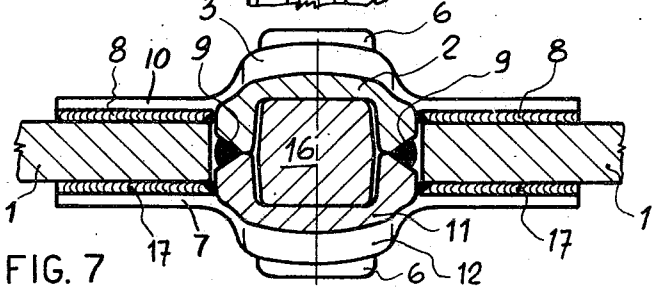

Referring to FIGS. 6 and 7, it will be seen that according to this embodiment whiile the lips 7 and 10 have inner peripheral edge regions overlapping and welded to the surfaces of the wall 1, the remainder of the shells 2 and 11 terminate in peripheral edges which are situated along the edge of the notch in the wall 1 without overlapping surfaces thereof, so that the weld lines 8 and 17 where they are located rearwardly of the lips 7 and 10 extend directly along the edge of the notch formed in the wall 1.

Figure 8:
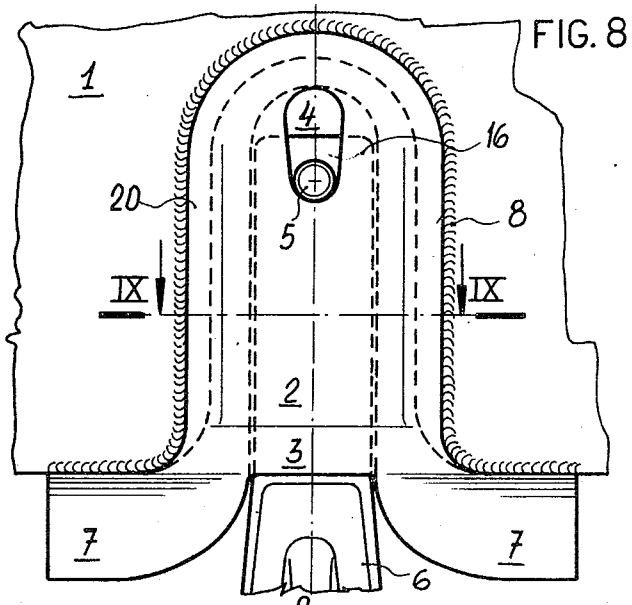
Figure 9:
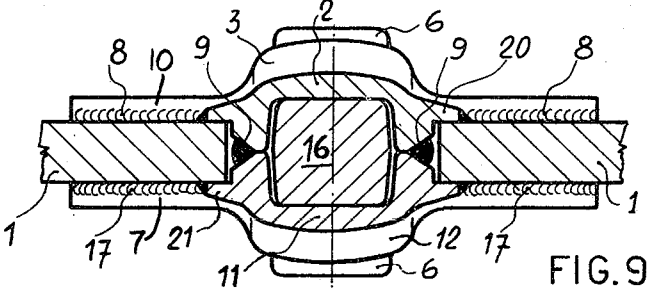

The embodiment of FIGS. 8 and 9, on the other hand, illustrates a construction where the lips 7 and 10 do not overlap surfaces of the wall 1, these lips terminating in inner end surfaces which are situated directly at the front cutting edge of the wall 1 while being directly welded thereto. On the other hand, the remainder of the shells 2 and 11 are provided with the peripheral edge regions 20 and 21 which overlap and are welded to the surfaces of the wall 1, as illustrated in FIGS. 8 and 9.

Figure 10:
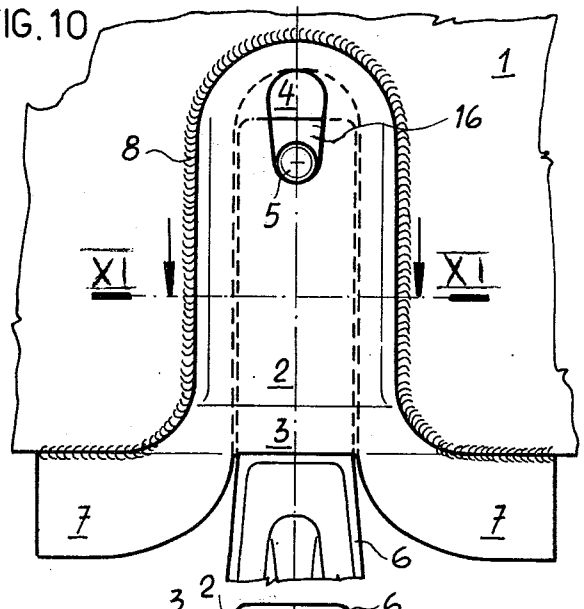

According to the embodiment of the invention shown in FIG. 10, there is no overlapping relationship between the surfaces of the wall 1 and the receptacle of the invention along the entire periphery of the receptacle. Moreover, it will be seen from FIG. 11 that in this case the lips have a total thickness which is no greater than the total thickness of the wall 1, so that these lips 7 and 10 project only forwardly from the wall 1 but not beyond the inner and outer surfaces of the wall 1, as is particularly apparent from FIG. 11.

Figure 13:
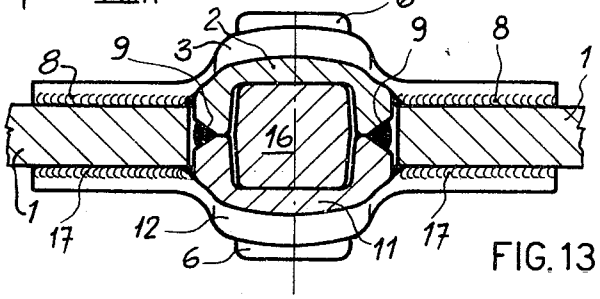
Figure 11:
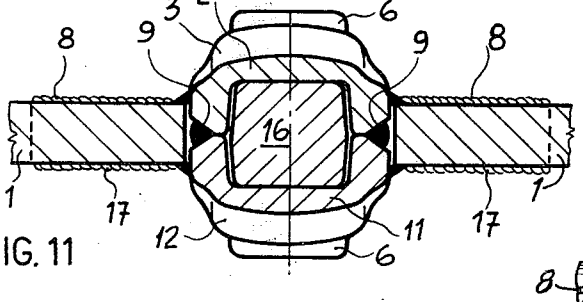

On the other hand, in FIGS. 12 and 13 there is shown a further variation which is similar to that of FIGS. 10 and 11 in that in this case also there is no overlapping relationship between the inner and outer surfaces of the wall 1 and the peripheral edge regions of the receptacle along the entire length of the latter. Thus with FIGS. 12 and 13 as with FIGS. 10 and 11 the receptacle is welded directly to the wall 1 at edges of the latter which form part of the front edge and the notch which receives the receptacle. However, in the case of FIGS. 12 and 13, the lips 7 and 10 have a total thickness which is greater than the thickness of the wall 1, as is apparent from FIG. 13. In the embodiment of FIGS. 12 and 13 as well as in the embodiment of FIGS. 8 and 9, the lips 7 and 10 have at their exterior a convex curvature in a plane perpendicular to the front cutting edge of the wall 1, as shown in FIG. 12A. On the other hand, with the embodiment of FIGS. 1–5, as well as with the embodiment of FIGS. 6 and 7, the lips 7 and 10 have,, as shown most clearly in FIG. 5, in a plane perpendicular to the front cutting edge of the wall 1, a cross section according to which the lips 7 and 10 have a minimum thickness at their front edges which are situated most distant from the front cutting edge of the wall 1, these lips 7 and 10 becoming gradually thicker toward the front cutting edge of the wall 1 and having their maximum thickness at the front cutting edge of the wall 1, as is shown in FIG. 5. With the embodiment of FIGS. 10 and 11, the lips 7 and 10 may taper forwardly in the inner shown for the lips 7 and 10 of FIG. 5, but in this case the maximum rear thickness of the lips situated directly next to the front edge of the wall 1 has a total thickness no greater than that of the wall 1.

Except for the above differences, the embodiments shown in FIGS. 6–13 are identical with the embodiment of FIGS. 1-5 describied in detail above.

FIGS. 14–26 show a further embodiment of the invention where a receptacle for the tooth 27 is made of the same material as the receptacle of FIGS. 1–13, but in the case of FIGS. 14–26, the pair of shells which are joined together to form the receptacle do not have an identical construction.

Referring to FIGS. 14–18, the front bucket wall 22, which corresponds to the wall 1, is shown therein, this wall being joined to the rear wall portion 43 and side wall portion 42 of the bucket, as illustrated in FIGS. 17 and 18.

The inner shell 23 corresponds to the inner shell 2 of FIGS. 1–13. However, it is only this inner shell 23 which is provided with the lip 28. This inner 23 has at its front a reinforcing protrusion 24 which extends in the general direction of the front cutting edge of the wall 22, but in the case of FIGS. 14–18, the opposed ends of the reinforcing protrusion 24 are joined with the front ends of rearwardly extending reinforcing ribs so that the pair of rearwardly extending ribs formed together with the protrusion 24 is substantially U-shaped reinforcing portion, as is shown most clearly in FIG. 15. The shell 23 is formed in its inner end region with an opening 25 to receive the means 26 for releasably holding the tooth 27 in the receptacle, this means 26 taking the form of a pin which can be bent as illustrated in FIG. 17 after being passed through an opening at the rear portion of the tang 37 of the tooth 26, this tang 37 being introduced into the receptacle as illustrated in FIG. 17.

The pair of front lips 28 of the shell 23 are thick enough to cover the entire thickness of the front wall 22 of the bucket. Thus, it will be seen from FIGS. 14, 15, 17, and 18 that the pair of lips 28 have rear peripheral edge regions which overlap and are welded directly to the inner surface of the wall 22, these overlapping inner edge regions of the lips 28 forming part of the peripheral edge region 38 of the entire shell 23 which overlaps and is welded directly to the inner surface of the wall 22 by the welding line 31 shown most clearly in FIG. 15. However, forwardly of this rear peripheral overlapping edge, the lips 28 respectively have depending portions 29 which extend downwardly through and beyond the total thickness of the wall 22, and the inner surfaces of the depending portions 29 of the lips 28 are suitably bevelled so as to form a groove for receiving the line of welding material 32 which serves directly to weld the inner surface regions of the lips 29 to the front cutting edge of the wall 22. One of the lips 28 is provided at its free end surface with a projecting rib 30 situated substantially midway between the inner and outer surfaces of the wall 22 and extending perpendicularly from the front cutting edge thereof. This projecting rib 30 is adapted to engage a free end surface of a lip such as one of the lips 35 of an adjoining shell, so that in this way the rib 30 will define with the end surface of the adjoining lip a pair of cavities for receiving welding material. Thus it will be noted that FIG. 14 shows the free end portion of a lip 35 of an adjoining receptacle.

The inner or upper shell 23 is welded to an outer or lower shell 33 which has at its front end a reinforcing protrusion 34 extending along the front cutting edge of the wall 22, this protrusion 34 also being joined at its opposed ends to a pair of rearwardly extending elongated reinforcing ribs so that the lower shell 33 also has a substantially U-shaped reinforcement at its exterior surface. As is shown most clearly in FIG. 16, the lower shell 33 does not extend beyond the notch of the wall 22 which receives the receptacle of the invention. As is apparent from FIG. 14, the pair of shells 23 and 33 define a front open end 36 for the receptacle, the tang 37 of the tooth 27 being introduced through the front open end 36 of the hollow interior of the receptacle into the latter in the manner shown most clearly in FIG. 17.

The outer shell 33 has a peripheral edge region 39 which is welded directly to the shell 23 and which serves to center the receptacle in the notch, the pair of shells 23, and 33 also being suitable bevelled at their exterior surfaces where they engages each other so as to receive a line of peripheral welding material 40 which serves to join the shells 23 and 33 to each other prior to introduction of the receptacle into the notch of the wall 22.

Once the receptacle is introduced into the notch and is properly situated therein, the receptacle is joineed to the wall not only by the continuous welding line 31 shown in FIG. 15 but also by a welding line 41 which extends along uhe peripheral edge 39 of the shell 33 and serves to weld the latter directly to the wall 22 along the edge of the notch thereof.

Thus, the embodiment of the invention shown in FIGS. 14-18 is assembled by first joining the shells 23 and 33 to each other along the welding line 40 to form from the shells the receptacle of the invention, and of course the lengths of the lips 28 are selected in accordance with the required distribution of the teeth with these lips being directly welded to adjoining lips of adjoining receptacles so that the front cutting edge of the wall 22 is completely reinforce with the structure of the invention. Once the receptacle is situated in the notch it is joined to the wall 22 by the welding material 31 as well as by the line of welding material 41 and the weld material 32 situated along the depending portions 29 of the lips as described above. Thereafter, the ends of the lips 28 are welded to the ends of adjoining lips of adjoining receptacles, as shown between the lips 28 and 35 in FIG. 14.

As is apparent particularly from FIG. 14, the rearwardly extending longitudinal ribs which extend from the opposed ends of the front reinforcing protrusion 24 forms substantial extensions of forwardly extending reinforcing ribs which are situated at the inner ends of the lips 28, curving inwardly therefrom to the ends of the protrusion 24 and forming a continuation of the front open end 36 of the receptacle.

Except for the above differences set forth in the detailed description of the embodiment of FIGS. 14–18, this embodiment is identical with that of FIGS. 1–5.

Figure 19:
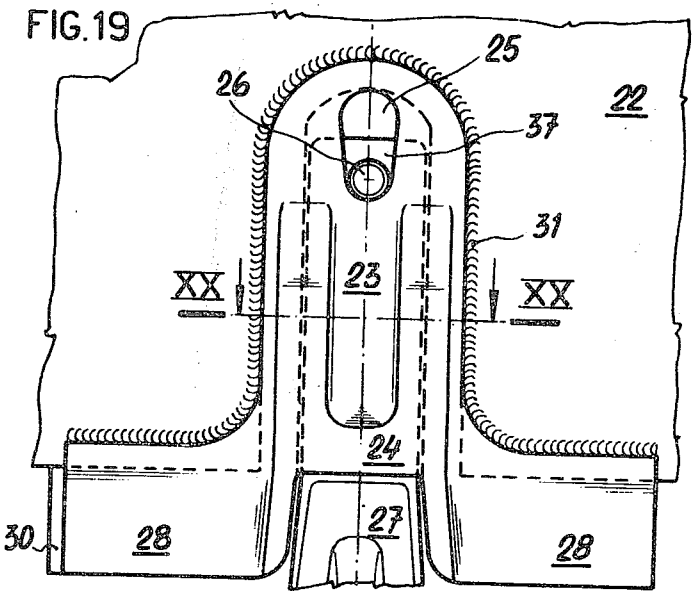
Figure 20:
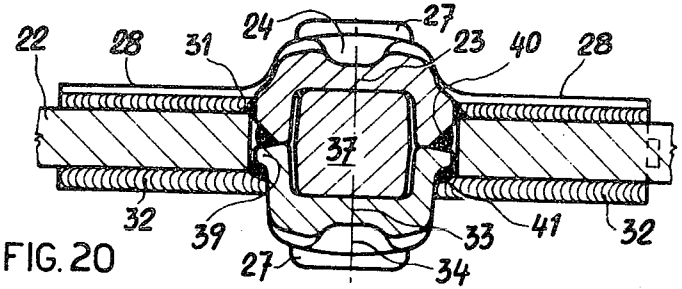

The embodiment of FIGS. 19 and 20 differs from that of FIGS. 14–18 only in that the shell 23 overlaps the inner surface of the wall 22 only at the inner portions of the lips 28. otherwise the shell 23 extends along the edge of the notch being directly welded thereto by the line of the weld 31 as shown in FIG. 19.

Figure 21:
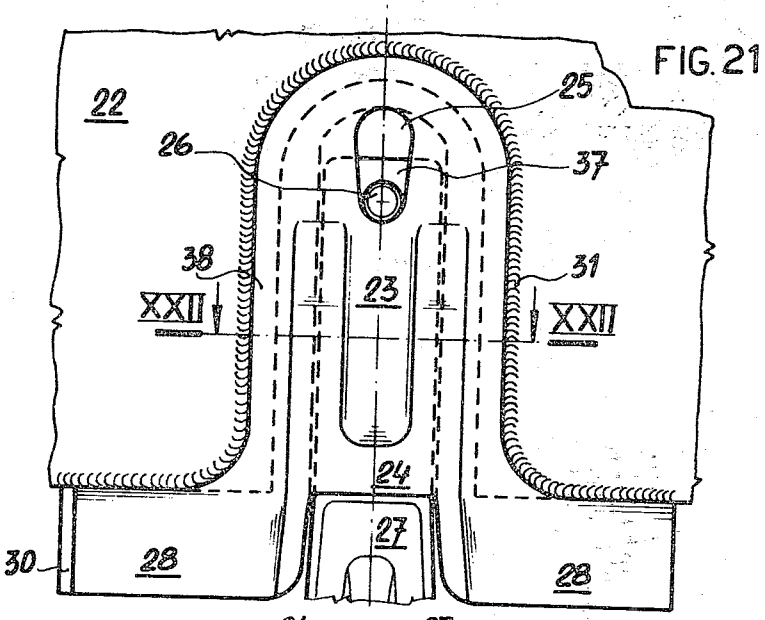
Figure 22:
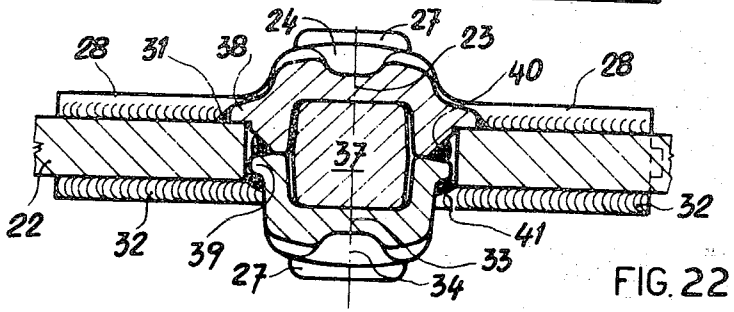

With the embodiment of the invention which is illustrated in FIGS. 21 and 22, on the other hand, the lips 28 do not overlap the inner surface of the shell. Instead the overlapping peripheral edge region 38 of the shell 23 extends only rearwardly from the lips 28 to overlap the inner surface of the shell and be welded thereto in the manner illustrated in FIGS. 21 and 22.

Figure 23:
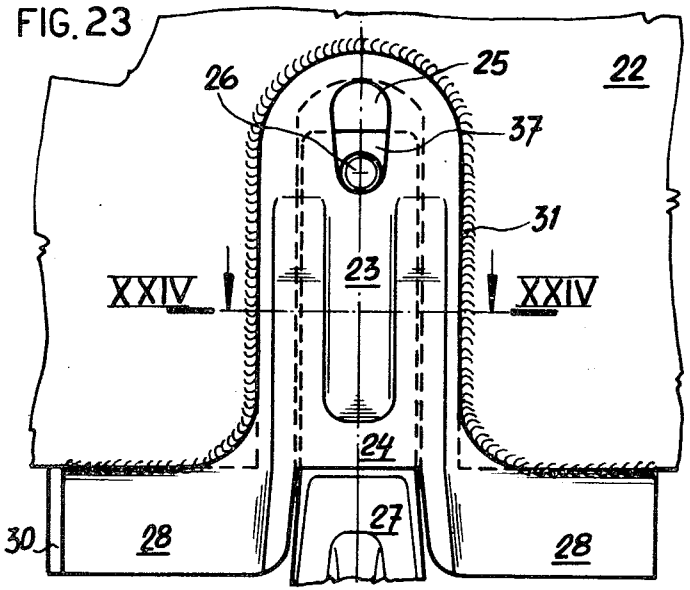
Figure 24:
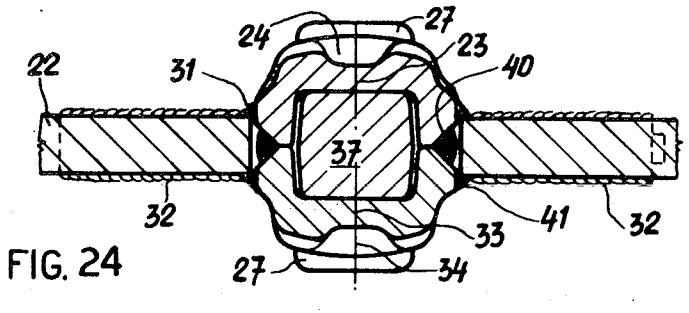

According to the embodiment of the invention which is illustrated in FIG. 23, the entire receptacle has no overlapping relationship with respect to the wall 22, the shell 23 in this case being welded only to edges of the wall 23 the front cutting edge and notch thereof as illustrated in FIGS. 23 and 24. Furthermore, as is apparent from FIG. 24, the lips 28 have a total thickness which is no greater than the total thickness of the wall 22.

Figure 25:
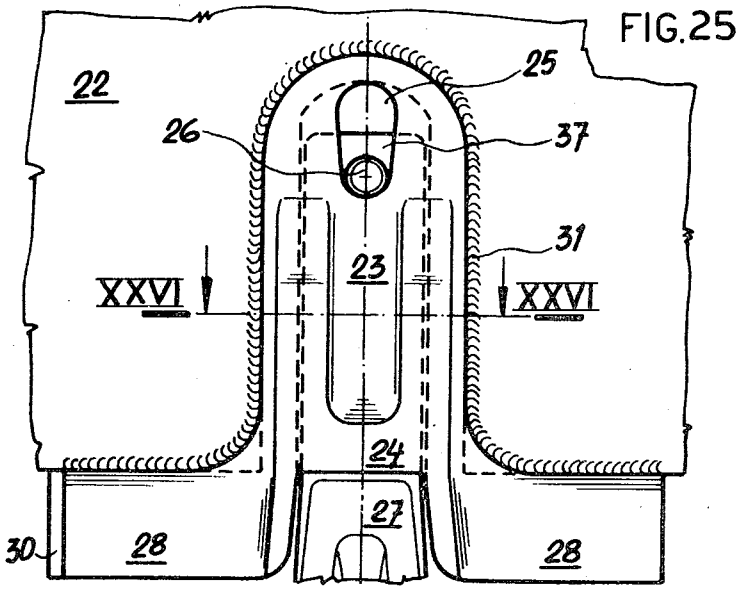
Figure 26:
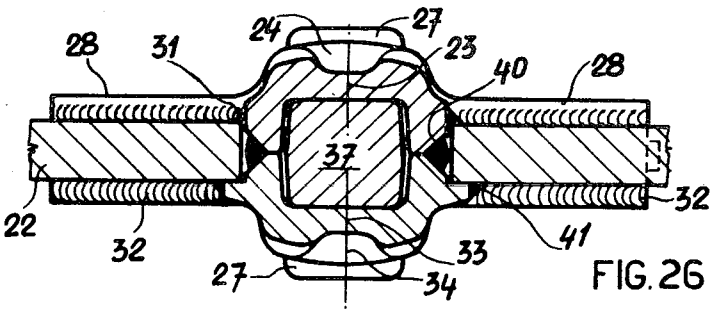

With the embodiment of FIGS. 25 and 26, while the entire receptacle also has no overlapping relationship with respect to the surfaces of the wall 22, as was the case with FIGS. 23 and 24, in this embodiment the lips 28 are thicker than the wall 22 and may have in a plane perpendicular to the front cutting edge of the wall 22 an exterior surface of convex curvature. On the other hand, as is apparent from FIG. 18, the lips 28 which overlap the inner surface of the wall 22 have a substantially triangular cross section minimum thickness at the front edge of the lips 28 which is most distant from the wall 22, with the lips 28 becoming of increasing thickness and having their maximum thickness along the front cutting edge of the wall 22 as is particularly apparent from FIG. 18.

It is thus apparent that with all of the embodiments of the invention described above there will be a major resistance to wear resulting from the anti-wear characteristics of the particular metal which is drop forged in order to form the structure of the invention. In practice, the particular dimensions, materials, and other details can vary considerably and certain elements may be replaced by equivalent elements. It will be noted that with all embodiments of the invention the entire front cutting edge region of the soft steel walls 1 and 22 are completely reinforced and protected by the receptacles of the invention, particularly by way of the lips thereof which are joined directly to each other at the several receptacles so as to form a complete protection for the soft steel of the walls 1 and 22.

What is claimed is:

1. In a bucket of an earth-moving machine or the like, a bucket wall having a front, substantially straight, cutting edge region, said bucket wall being formed with an elongated notch extending therethrough inwardly from said front cutting edge region while being substantially perpendicular thereto, and a receptacle for receiving the tang of a bucket tooth, said receptacle being made in its entirety of a relatively hard, wear-resistant material and said receptacle being situated in said notch and having an outer peripheral region welded to said bucket wall and extending along said notch, said receptacle having an elongated hollow interior terminating in a front open end situated aproximately at the front cutting edge region of said wall for receiving a bucket-tooth tang introduced into the hollow interior of said receptacle through said front open end thereof, said receptacle being adapted to accommodate at an inner end region thereof a means for fixing a bucket tooth to said receptacle by cooperation with said tang of said bucket tooth, said receptacle being composed in its entirety of a pair of shells which together define the hollow interior of said receptacle, said shells engaging each other at surfaces of said shells which are situated in said notch and which are welded to each other to form said receptacle from said shells, and at least one of said shells having a pair of front lips projecting laterally respectively in opposed directions from said front open end of said receptacle and extending along while being welded to said front cutting region of said bucket wall, said lips respectively terminating in free ends adapted to be welded to free ends of adjoining lips of adjoining receptacles adapted to be received in additional notches of said bucket wall, and each of said shells having at the front of said receptacle an elongated reinforcing protrusion extending in the general direction of said front cutting edge of said bucket wall.

2. The combination of claim 1 and wherein said pair of shells are identical and engage each other at surfaces of said shells which are situated in a common plane located substantially midway between inner and outer surfaces of said bucket wall, and both of said shells respectively having a pair of said front lips which also engage each other in said common plane and which are welded to each other as well as to said front cutting edge region of said bucket wall.

3. The combination of claim 2 and wherein said hollow interior of said receptacle has a central axis extending inwardly from said front open end of said hollow interior to said inner end region of said receptacle, and each of said shells having a pair of opposed side edges extending parallel to said axis while said lips of each shell extends substantially perpendicular to said axis and terminate in said free ends which are substantially parallel to said axis.

4. The combination of claim 2 and wherein each shell has a peripheral edge region extending along the entire length of each shell while overlapping a surface of said bucket wall and being welded thereto.

5. The combination of claim 2 and wherein each lip has a front edge of minimum thickness with each lip increasing in thickness from said front edge thereof inwardly toward said front cutting edge region of said bucket wall so that each lip has an increasing thickness rearwardly from said front edge thereof toward said cutting edge region of said bucket wall.

6. The combination of claim 2 and wherein said lips of said shells have inner peripheral edge regions which overlap and are welded to said bucket wall while the remainder of said shells terminate in outer edge regions which are situated along said notch of said bucket wall without overlapping the latter.

7. The combination of claim 2 and wherein said lips of said shells have inner edge regions extending along the front cutting edge region of said bucket wall without overlapping the latter whereas the remainder of said shells which extend into said notch have peripheral edge regions which overlap and are welded to surfaces of said bucket wall at the region of said notch thereof.

8. The combination of claim 7 and wherein the total thickness of the lips of the pair of shells is greater than the total thickness of said bucket wall and each lip having an exterior surface which is convexly curved in a plane which is perpendicular to said front edge region of said bucket wall.

9. The combination of claim 2 and wherein both of said shells have along their entire length edge regions located next to said bucket wall without overlapping the latter while being welded thereto.

10. The combination of claim 9 and wherein the total thickness of said lips of said shells is no greater than the total thickness of said bucket wall at said front cutting edge region thereof while being in line with said bucket wall at said front cutting edge region thereof so that said lips do not project beyond surfaces of said bucket wall.

11. The combination of claim 2 and wherein said lips of both shells project forwardly from the front cutting edge region of said bucket wall without overlapping said front cutting edge region while the remainder of said shells which are situated in said notch have peripheral edge regions which overlap and are welded to surfaces of said bucket wall which are situated in the region of said notch.

12. The combination of claim 11 and wherein said lips of said shells have a total thickness greater than the thickness of said bucket wall at said front cutting edge region thereof while each lip has an exterior surface of convex curvature in a plane perpendicular to the front cutting edge region of said buckt wall.

13. The combination of claim 1 and wherein only one of said shells has said lips, the latter extending forwardly and laterally from said reinforcing protrusion of said one shell, while said other shell terminates at its front end in said reinforcing protrusion thereof.

14. The combination of claim 13 and wherein said one shell has at its exterior a pair of rear longitudinal reinforcing ribs extending rearwardly from opposed end regions of said reinforcing protrusion of said one shell as well as a pair of front reinforcing ribs extending forwardly from said opposed end regions of said reinforcing protrusion and forming substantial extensions of said rear reinforcing ribs while being situated at inner ends of said lips which are located at said front open end of said hollow interior of said receptacle.

15. The combination of claim 14 and wherein said other shell also has a pair of rearwardly extending longitudinal reinforcing ribs extending at the exterior of said other shell rearwardly from opposed end regions of said reinforcing protrusion of said other shell.

16. The combination of claim 13 and wherein one of said lips terminates in a free end surface having substantially midway between opposed surfaces of said bucket wall at said front cutting edge region thereof a rib which projects forwardly from said front cutting region of said bucket wall and which is adapted to engage a free end surface of an adjoining lip to define therewith cavities for receiving welding material.

17. The combination of claim 13 and wherein said one shell has along its entire length a peripheral edge region which overlaps a surface of said bucket wall and is welded thereto.

18. The combination of claim 13 and wherein each lip has in a plane which is transverse to each lip and perpendicular to said front cutting edge region of said bucket wall a substantially triangular cross section forwardly of said front cutting edge region of said bucket wall, said triangular cross section of each rib having a minimum thickness at a front edge of each lip with each lip gradually increasing in thickness rearwardly from said front edge thereof toward said front cutting edge region of said bucket wall while each lip has a maximum thickness substantially at said front cutting edge region of said bucket wall.

19. The combination of claim 18 and wherein each lip has at the side of said other shell an elongated portion situated adjacent but extending only forwardly from said front cutting edge region of said bucket wall while being directly welded thereto.

20. The combination of claim 13 and wherein only said lips overlap a surface of said bucket wall and are welded thereto while the remainder of the receptacle has a non-overlapping relationship with respect to said bucket wall while being welded thereto.

21. The combination of claim 13 and wherein the entire receptacle has a non-overlapping relationship with respect to said bucket wall while being welded thereto along said notch and along the front cutting edge region of said bucket wall where said lips are located.

22. The combination of claim 13 and wherein said other shell has a peripheral edge region overlapping a surface of said bucket wall and welded thereto.

23. The combination of claim 13 and wherein said bucket wall has inner and outer surfaces, and said one shell being joined to said bucket wall at said inner surface thereof.

24. The comination of claim 1 and wherein said shells are exteriorly bevelled at said surfaces where they engage each other to define at said surfaces an outer V-shaped groove for receiving welding material for joining said shells to each other.

* * * * *